US005657955A

United States Patent [19]

Adams

[11] Patent Number: 5,657,955

[45] Date of Patent: Aug. 19, 1997

[54] PROTECTIVE PAD

[75] Inventor: William E. Adams, Portersville, Pa.

[73] Assignee: Adams Mfg. Corp., Portersville, Pa.

[21] Appl. No.: 372,655

[22] Filed: Jan. 13, 1995

[51] Int. Cl.[6] ..... A47B 95/00

[52] U.S. Cl. ..... 248/345.1; 428/172; 428/194; 428/343

[58] Field of Search ..... 248/345.1, 188.9, 248/346.01; 206/586; 52/288.1, 821, 829; 108/27, 90, 161; 428/121, 172, 194, 343

[56] References Cited

U.S. PATENT DOCUMENTS

| | | | |
|---|---|---|---|
| 2,674,433 | 4/1954 | Mautner | 206/586 |
| 3,200,547 | 8/1965 | Johnson | 206/586 |
| 3,244,347 | 4/1966 | Jenk | 206/586 |
| 3,314,584 | 4/1967 | Knapp | 206/586 |
| 4,202,449 | 5/1980 | Bendt | 206/586 |
| 4,554,616 | 11/1985 | McIntosh | 361/424 |
| 4,582,739 | 4/1986 | Givens | 248/345.1 |
| 4,877,673 | 10/1989 | Eckel | 206/586 |

*Primary Examiner*—Leslie A. Braun
*Assistant Examiner*—Gwendolyn W. Baxter
*Attorney, Agent, or Firm*—Buchanan Ingersoll PC

[57] ABSTRACT

A protective pad formed of a flexible plastic having a durometer rating of between about 50 and 75, such as vinyl, has a body with an upper surface, a lower surface having an adhesive thereon, a first end, and a second end. The upper surface includes a first, or greater, transverse notch having a first depth. The lower surface includes a second, or lesser, transverse notch having a second depth. The depth of the first notch is at least three times greater than the depth of the second notch. This configuration enables the pad to overcome the shape memory of the plastic so that the pad does not tend to peel away from a corner or other contoured surface to which it has been applied.

11 Claims, 3 Drawing Sheets

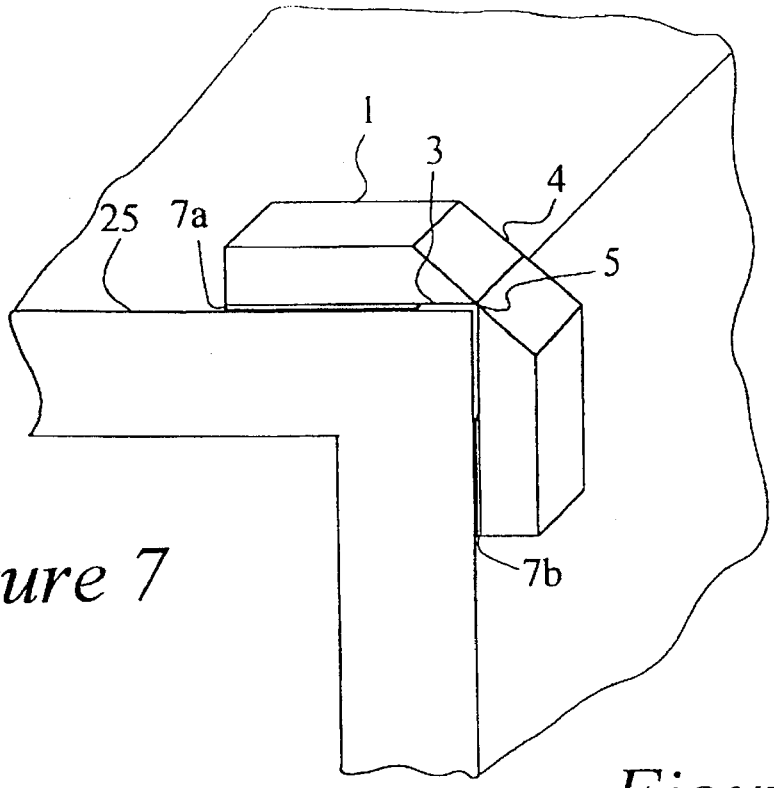
Figure 7
Figure 8
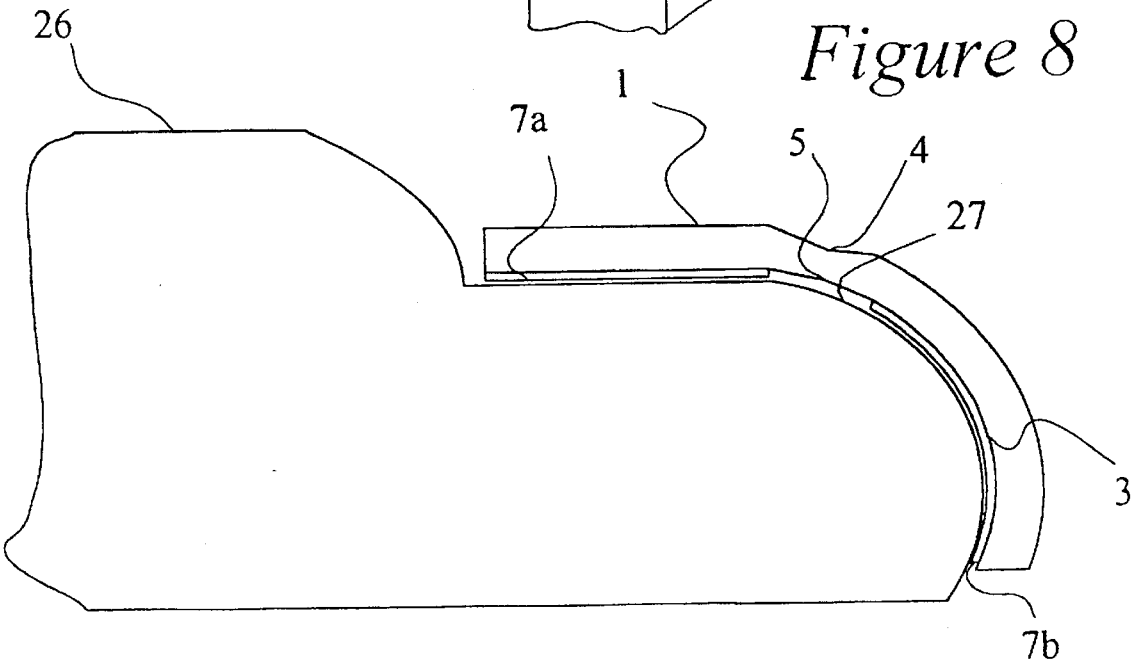

PROTECTIVE PAD

BACKGROUND OF THE INVENTION

1. Field of the Invention

This invention relates to protective pads for attaching to edges of objects, including tables, desks, and the like.

2. Description of the Prior Art

The use of protective pads for shielding the edges of an object is well known. Protective pads typically consist of a flexible or rigid plastic that may be mounted with an adhesive upon the surface of the object to prevent marring of the edge. The protective device may be pre-molded to fit the shape of the object to be protected or molded in a standard shape which is bent to conform to the object to be protected when the protective device is attached to the object. Use of protective pads which are manufactured in a form which is generally conformant with an edge, such as a corner, is limited to objects having that edge. Because of their cross-linked structure, plastic materials have a tendency to resist deformation and retain their original shape. Consequently, when a plastic protector is deformed to fit over an object, it seeks to return to its original shape and pulls itself away from the object. This property can be referred to as the "shape-memory" effect. The art has attempted to overcome the shape-memory effect of the flexible plastic pad by using stronger adhesives to retain the pads on the object's surface. Such adhesives are usually more expensive and difficult to remove without marring the object.

There is a need for an inexpensive, flexible protective pad for safeguarding the edges of objects from damage which will overcome inherent shape-memory effects of the constituent flexible plastic.

SUMMARY OF THE INVENTION

I provide a flexible protective pad which can be fitted securely on the edge of an object. The edge may be a right angle or contoured. Because my pad is configured to overcome the shape-memory effect found in some flexible plastics, the pad does not constantly attempt to regain its original shape. By overcoming the shape-memory effect, my pad thus can be retained on the edge of the object to which it is affixed for longer periods than otherwise would be possible with a given adhesive.

The protective pad herein has a body with an upper surface, a lower surface, a first end, and a second end. It is formed of a flexible plastic with a durometer rating of between about 50 and 75, such as, for example, vinyl. The upper surface includes a first, or greater, transverse notch having a first depth. The lower surface includes a second, or lesser, transverse notch having a second depth. The depth of the first notch is at least three times greater than the depth of the second notch. In addition, the greater transverse notch is generally aligned with the lesser transverse notch, thus forming a web portion therebetween. So that the body of the protective pad can be securely attached to a desired object, an adhesive is affixed to at least part of the lower surface.

The protective pad body can be tapered or untapered. In addition, the body may have either a curvilinear axial cross-section or a rectilinear axial cross-section. Also, the protective pad can be either generally symmetric with the notches located midway between the ends, or asymmetric, wherein the greater and lesser transverse notches are located closer to the first end than to the second end.

Other details, objects, and advantages of the invention will become apparent as the following description of certain present preferred embodiments thereof proceeds. The accompanying drawings show presently preferred embodiments of the invention.

BRIEF DESCRIPTION OF THE DRAWINGS

FIG. 7 is an illustration of one embodiment of a protective pad as attached to an object having a rectangular corner.

FIG. 8 is an elevation view of a protective pad as affixed to an object having a contoured corner.

DETAILED DESCRIPTION OF THE PREFERRED EMBODIMENTS

Figure 1:
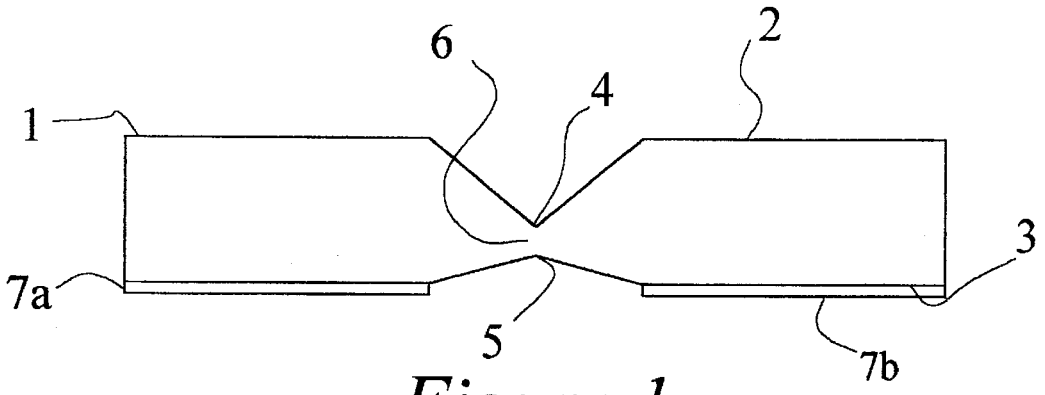
FIG. 1 is an side view of one embodiment of a protective pad according to the invention herein.
Figure 4:
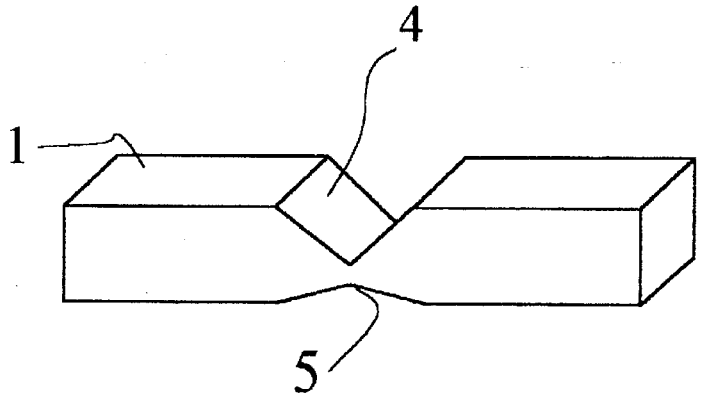
FIG. 4 is a perspective view of the protective pad of FIG. 1.

As seen in FIGS. 1 and 4, protective pad body 1 has an upper surface 2 and a lower surface 3. Each surface 2, 3 of body 1 has a notch 4, 5, respectively, extending transversely thereacross. The first, or greater, transverse notch 4 is generally aligned with the second, or lesser, transverse notch 5. Between the vertices of greater transverse notch 4 and lesser transverse notch 5 is formed a web portion 6. The depth of greater transverse notch 4, as measured from a plane coincident with upper surface 2 to the vertex of greater transverse notch 4, is at least three times greater than the depth of transverse notch 5, as measured between a plane coincident with lower surface 3 of body 1 and the vertex of lesser transverse notch 5. Preferably, the angle at the vertex of greater transverse notch 4 is 90°. When a protective pad having that angle is placed on a right angle corner, the sides of greater transverse notch 4 are in the same plane providing the largest possible flat surface.

So that the protective pad can be affixed to the surface of the object to be protected, an adhesive *7a, 7b,* such as double-faced adhesive tape, can be applied to at least a portion of lower surface 3 for attachment to the desired object. It is preferred that the adhesive not be applied to the surface of lesser notch 5.

It is preferred that pad body 1 be made of a flexible plastic with a durometer rating of between 50 and 75, such as, for example, vinyl. Vinyl and other flexible plastics exhibit a shape-memory effect where the plastic object, when deformed, is constantly trying to regain the original shape. The shape-memory effect acts to weaken the adhesive bond and can cause the pad to detach from the surface to which it is attached. However, this action is overcome by notches 4 and 5. The position and depth of lesser notch 5 relative to greater notch 4 defeats the shape-memory effect and, thus, permit the pad body 1 to be more durably retained on to the edge of the object. In addition, stronger adhesives may not be required to overcome the shape-memory effect, as is currently the case, so that the use of adhesives which have a greater tendency to mar the object's surface can be avoided.

Figure 2:
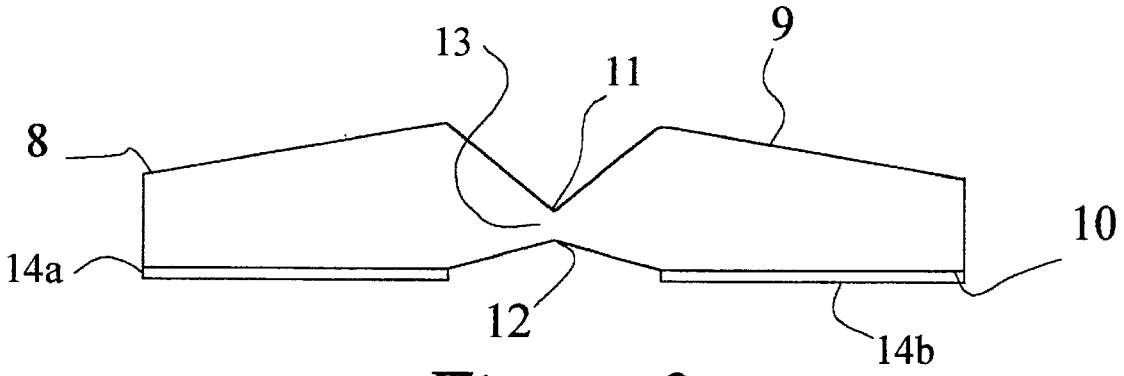
FIG. 2 is an side view of a second embodiment of a protective pad according to the invention herein.
Figure 5:
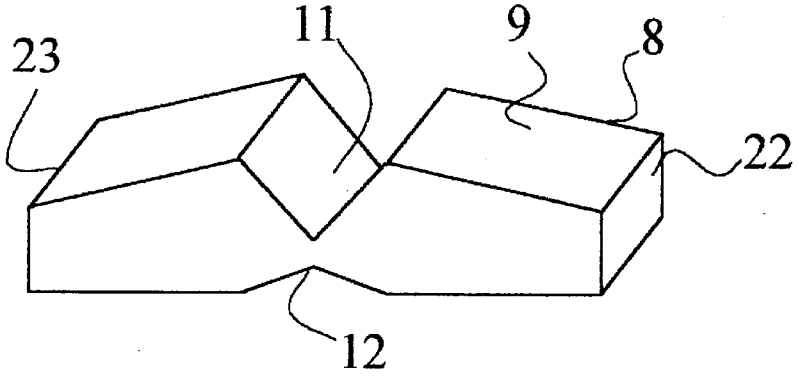
FIG. 5 is a perspective view of the protective pad of FIG. 2.

The second embodiment of my protective pad is generally tapered, as shown in FIGS. 2 and 5. This embodiment is otherwise similar to the pad shown in FIG. 1. Body 8 has upper surface 9 with greater transverse notch 11 extending thereacross. Lower surface 10 also has lesser transverse notch 12 which is generally aligned with transverse notch 11. The depth of greater transverse notch 11 is at least three times the depth of lesser transverse notch 12. Also as in FIG. 1, the embodiment of web portion 13 is formed between the opposing vertices of greater transverse notch 11 and lesser transverse notch 12. Tapered body 8 can be attached to the desired object by adhesive 14*a*, 14*b* which may be double-faced adhesive tape applied to lower surface 10.

Figure 3:
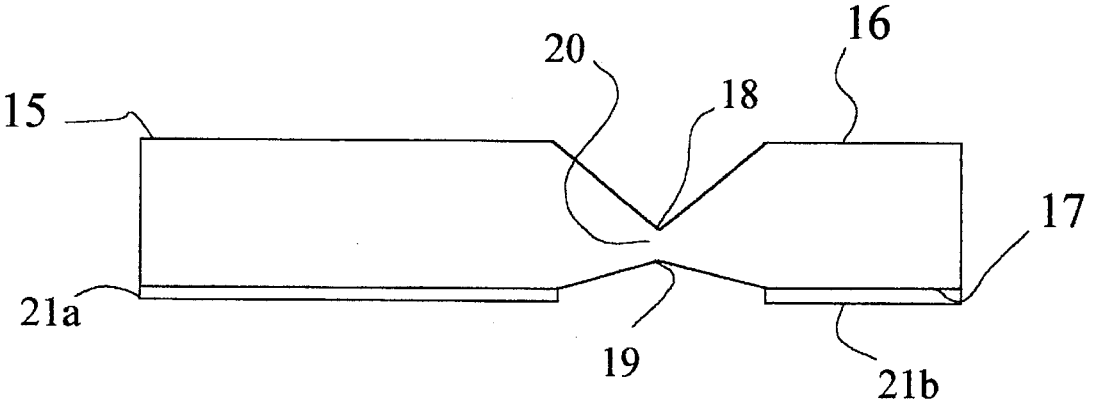
FIG. 3 is an side view of a third embodiment of a protective pad according to the invention herein.

The embodiments of FIGS. 1 and 2 have bodies 1 and 8 that are longitudinally symmetric about transverse notches 4 and 5, and 11 and 12, respectively, that is, notches 4 and 5, and 11 and 12 are located approximately midway between the ends of the respective pad bodies. In the third embodiment shown in FIG. 3, greater transverse notch 18 and lesser transverse notch 19 are placed closer to one end such that the portion of body 15 on one side of the notches is longer than the other portion of body 15 on the other side of the notches. As in the embodiments of FIGS. 1 and 2, greater transverse notch 18 of FIG. 3 is formed in upper surface 16 and lesser transverse notch 19 is formed in lower surface 17. The depth of greater transverse notch 18 is at least three times the depth of lesser transverse notch 19. Between the vertices of transverse notches 18 and 19 is a web portion 20. Protective pad body 15 can be attached to the desired object by adhesive 21*a*, 21*b*, which may be double-faced adhesive tape applied to lower surface 17.

FIG. 4 shows an embodiment of the protective pad in FIG. 1 wherein pad body 1 is generally untapered and is symmetric about greater notch 4 and lesser notch 5. However, in FIGS. 2 and 5, it can be seen that pad body 8 may be tapered. In this embodiment, it is preferred that the taper be symmetrical about greater transverse notch 11 with the thicker portion of body 8 being disposed closest to the edges of notch 11 and sloping generally uniformly towards either of ends 22 and 23. It is preferred that body 8 be tapered with respect to upper surface 9.

Figure 6:
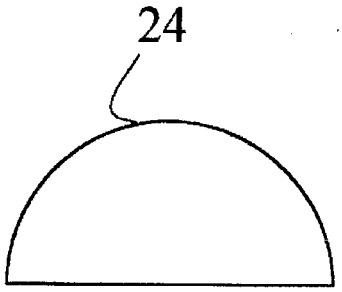
FIG. 6 is an illustration of an alternate axial cross section for a protective pad.

As seen in FIGS. 1–5, the pad bodies 1, 8, and 15, respectively, have a generally rectilinear axial cross-section. Such a rectilinear cross section can include a rectangular cross-section of the embodiment shown in FIG. 5 and a square cross-section of the embodiment of FIG. 4. However, in another preferred embodiment according to the present invention, protective pad bodies 1, 8, and 15, respectively, of FIGS. 1–5 can also have a generally curvilinear axial cross-section 24 as seen in FIG. 6. Such a curvilinear cross section can include a hemi-circle.

FIG. 7 shows the protective pad 1 of FIG. 1 attached to a desired object 25 by double-faced adhesive tape portions 7*a*, 7*b*, which are disposed along at least a portion of the lower surface 5 of pad 1. It is preferred that tape portions 7*a*, 7*b* not be disposed on the surface of lesser notch 5. When pad 1 is properly attached to the corner edge of object 25, the internal faces of lesser notch 5 are approximated, and pad 1 assumes an L-shape which provides protection for the corner edge of object 25. Also, in this configuration, greater notch 4 opens so that the interior faces of notch 4 are flattened and generally lie along the same plane.

In yet another preferred embodiment, as seen in FIG. 8, protective pad 1 is attached to desired object 26 which has a contoured edge 27. Pad 1 is attached to contoured edge 27 of object 26 with double-faced adhesive tape portions 7*a*, 7*b*. Tape portions 7*a*, 7*b*, occupy at least a portion of lower surface 3 of pad 1, but not be disposed within lesser notch 5, so that notch 5 is permitted to deform and thus be unaffected by the memory of body 1 for its original typically flat form.

An experiment comparing an unnotched protective pad with a protective pad, notched as provided herein, was performed by attaching both pads to a contoured surface using double-faced adhesive tape with a low to medium tack, made by 3M Corporation. Within a few hours, the unnotched pad pulled away from the contoured surface while the notched pad has remained attached for several months.

While specific embodiments of practicing the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting to the scope of the invention which is to be given the full breadth of the following claims, and any and all embodiments thereof.

I claim:

1. A protective pad, comprising:

a body having an upper surface, a lower surface, a first end, and a second end, and formed of a flexible plastic with a durometer rating of between about 50 and 75;

said upper surface having a first transverse notch, said first transverse notch having a first depth;

said lower surface having a second transverse notch, said second transverse notch having a second depth;

said first transverse notch being generally aligned with said second transverse notch and forming a web portion therebetween;

said first depth being at least three times said second depth; and an adhesive affixed to at least part of said lower surface for attaching said pad to an object wherein said first and second transverse notches defeat a shape memory effect permitting said protective pad to be retained on said object.

2. The pad of claim 1 wherein said body is tapered.

3. The pad of claim 1 wherein said body has a generally rectilinear axial cross-section.

4. The pad of claim 1 wherein said body has a generally curvilinear axial cross-section.

5. The pad of claim 4 wherein said flexible plastic is vinyl.

6. The pad of claim 3 wherein said generally rectilinear axial cross-section is a rectangle.

7. The pad of claim 3 wherein said generally rectilinear axial cross-section is a square.

8. The pad of claim 4 wherein said generally curvilinear axial cross-section is a hemi-circle.

9. The pad of claim 1 wherein each of said first and second transverse notches are located approximately midway between said first end and said second end.

10. The pad of claim 1 wherein each of said first and second transverse notches is located closer to said first end than to said second end.

11. The pad of claim 1 wherein the first transverse notch has a pair of sides which intersect at a 90° angle.

* * * * *